United States Patent [19]

Woodburn et al.

[11] 4,025,337

[45] May 24, 1977

[54] CONTINUOUS METHOD OF AND APPARATUS FOR MAKING BARS FROM POWDERED METAL

[75] Inventors: James Woodburn, Wheaton; Gordon Russell Lohman, Glen Ellyn, both of Ill.

[73] Assignee: Amsted Industries Incorporated, Chicago, Ill.

[22] Filed: Mar. 28, 1975

[21] Appl. No.: 562,873

Related U.S. Application Data

[62] Division of Ser. No. 448,819, March 7, 1974, Pat. No. 3,897,184.

[52] U.S. Cl. ..... 75/214; 75/200; 425/79; 425/149; 264/111

[51] Int. Cl.[2] ..... B22F 3/12

[58] Field of Search ..... 75/200, 214; 425/79, 425/78, 149; 264/111

[56] References Cited

UNITED STATES PATENTS

| | | | |
|---|---|---|---|
| 1,806,300 | 5/1931 | Lemming | 425/78 X |
| 2,097,502 | 11/1937 | Southgate | 75/214 |
| 2,289,787 | 7/1942 | Kaschke et al. | 75/214 |
| 2,389,561 | 11/1945 | Stokes et al. | 425/78 |
| 2,499,980 | 3/1950 | Stokes et al. | 425/79 |
| 2,651,180 | 9/1953 | Haller | 425/79 |
| 2,651,952 | 9/1953 | Leavenworth | 425/79 |
| 2,656,743 | 10/1953 | Leavenworth | 425/79 |
| 2,844,845 | 7/1958 | Krau | 425/79 |
| 2,902,714 | 9/1959 | Johnson | 425/79 |
| 2,904,835 | 9/1953 | Thomas | 425/78 |
| 2,984,866 | 5/1961 | Schwabe | 425/78 X |
| 3,264,388 | 8/1966 | Roach | 425/78 X |
| 3,491,407 | 1/1970 | Gustafason | 425/78 |
| 3,579,741 | 5/1971 | Schwartz | 425/149 |
| 3,734,663 | 5/1973 | Holm | 425/149 |
| 3,788,787 | 1/1974 | Silbereisen et al. | 425/78 |
| 3,819,774 | 6/1974 | Eggenberger et al. | 425/149 X |

*Primary Examiner*—Richard E. Schafer
*Attorney, Agent, or Firm*—Fred P. Kostka; William G. Anderson

[57] ABSTRACT

Powdered metal is continuously introduced into a die cavity in discrete quantities and compacted into bar segments to form a bar. The cavity has a fixed cross-sectional area and is open at both ends, except during the initial compaction when one end is closed. After formation of a length of the bar, the frictional resistance between the bar and the cavity wall is relied on so that the bar remaining in the cavity serves as a stopper for subsequent compactions of the discrete quantities of powdered metal to form the continuous bar. The bar is forced out of the cavity and may be passed through an induction furnace for sintering, and through a swager, all preferably in a continuous operation. Also provided is means for varying the compaction so that the bar lengths formed from the discrete quantities of powdered metal are compacted and bonded into a bar of substantially uniform physical characteristics along its length.

12 Claims, 11 Drawing Figures

20

30
28
56
52
32
3
33
54
48
50
44
34
45
36
46
26
5.
3
5.
82
38
22
40
24
42
94

Fig. 4.
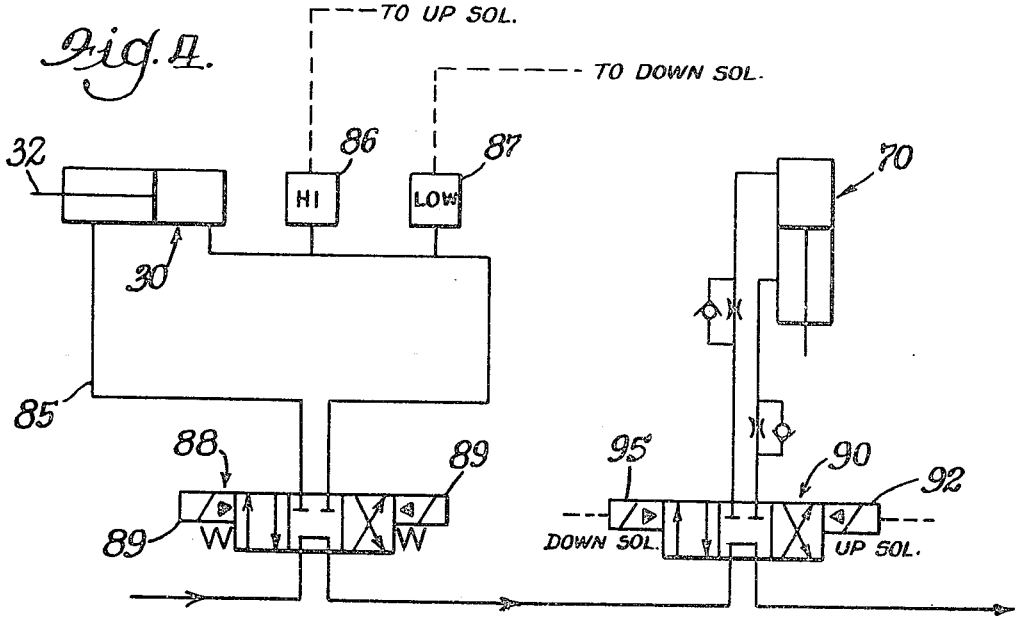
Fig. 5.
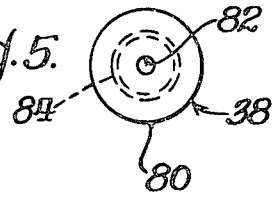
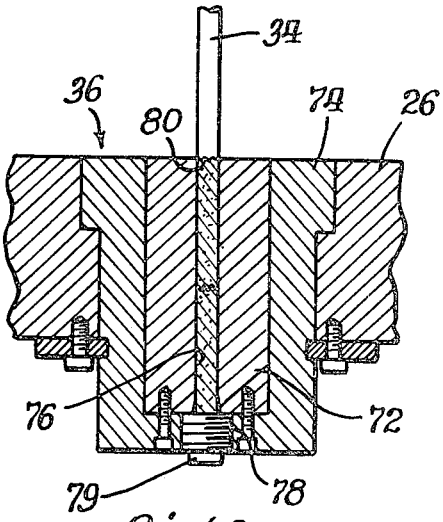
Fig. 6.
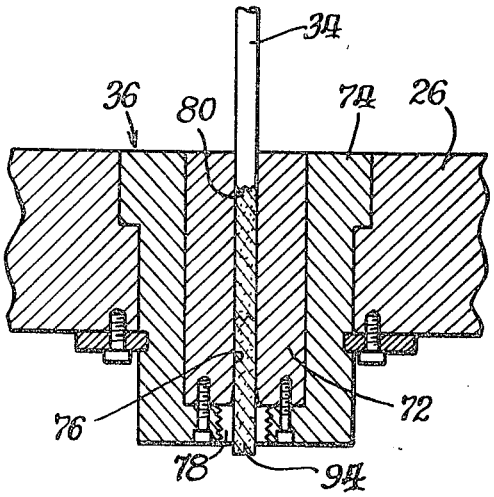
Fig. 7.

CONTINUOUS METHOD OF AND APPARATUS FOR MAKING BARS FROM POWDERED METAL

This is a division of application Ser. No. 448,819, filed Mar. 7, 1974 now U.S. Pat. No. 3,897,184.

BACKGROUND AND SUMMARY OF THE INVENTION

The present invention relates to a method and apparatus for making a rod from powdered metal, and more particularly to a new and novel method for continuously forming the rod from powdered metal and to a new and novel apparatus for carrying out the method.

One method and an apparatus for continuously forming rod from powdered metal is described in U.S. Pat. 2,097,502 granted Nov. 2, 1937. This method comprises generally the compaction and compression of successive lengths of rod in a mold including die members which are separable to release pressure radially applied by the die members and thereby to release a length of rod from the mold. The rod thus formed is subsequently sintered.

By the present invention it is proposed to provide an improved method for continuously forming a bar from a powdered metal wherein successive separate quantities of powdered metal are axially compacted by compacting means axially moveable in a unitary die having a cavity of fixed cross-sectional area into bar segments bonded to each other to form a green compact bar. The green compact bar is incrementally forced out of the die such that a length thereof is frictionally retained within the die to serve as a stopper against which a succeeding quantity of powdered metal is compacted. The frictional resistance force between the cavity wall and the length of the bar defining the stopper is measured. This measurement is used to determine if the frictional resistance force corresponds to the compacting force required to compact the quantity of powdered metal into a bar segment having desired physical characteristics. If the frictional force deviates from the required force, the length of travel of the compacting means and the volume of powdered metal are varied relative to each other until the measured resisting force corresponds to the required compacting force whereby the powdered metal is compacted into a bar segment having the desired physical characteristics.

In accordance with the present invention the compaction is accomplished by a punch which is reciprocable within the die cavity. The required frictional force is maintained by controlling the length of travel of the punch in the cavity so that the quantity of powdered metal is compacted to provide a green compact rod of substantially uniform physical characteristics along its length.

The green compact rod formed in the continuous manner as described above is then sintered to improve the physical characteristics after emerging from the die. Preferably the sintering is performed by induction heating means.

After sintering the rod may also be swagged or otherwise hot worked to further increase the density thereof.

Further features of the invention will hereinafter appear.

BRIEF DESCRIPTION OF THE DRAWINGS

FIG. 4 is a schematic diagram of the control system utilized in the apparatus for controlling the length of stroke of the ram.

FIG. 5 is a top plan view of the induction means for sintering the rod taken generally along the lines 5—5 of FIG. 1.

FIG. 6 is a view similar to FIG. 3 but showing the ram punch prior to the compaction of a further quantity of powder and before removal of the closure plug in the lower end of the die.

FIG. 7 is a view similar to FIG. 6 but with the closure plug removed and a length of the rod emerging from the die.

Figure 3:
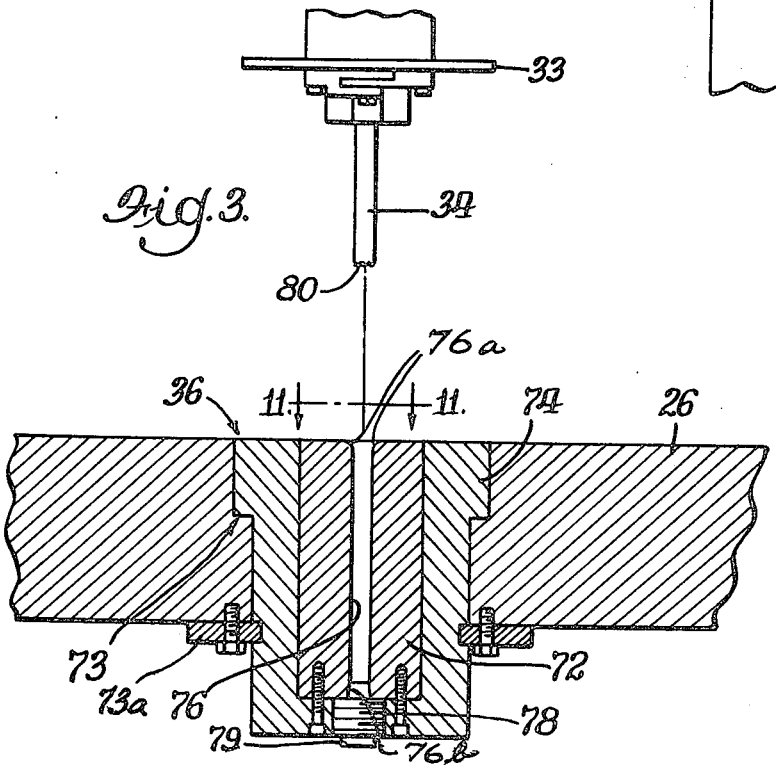
FIG. 3 is a view partly in section taken generally along the lines 3—3 of FIG. 1 showing the die with the die closure plug in assembled position.

Referring now to the drawings, there is shown an apparatus or press 20 including a frame 22 having a lower frame unit 24, a bed 26 and a super structure frame unit 28. Supported in the upper unit 28 is a cylinder-ram device or jack 30, preferably hydraulic, for applying the compacting pressure to form the rod from powdered metal. The jack includes a ram 32 having a punch 34 attached thereto. The ram 32 carries a switch actuator 33 which may be in the form of a plate, as shown. Incorporated in the bed 26 is a die unit 36 (see also FIG. 3) and located below the bed 26, is a sintering unit 38. Below the sintering unit 38 is a conventional rotary swager creeping spindle 40. A continuous bar take-up or supply holder 42, as schematically illustrated, is located at the base of the apparatus.

Figure 2:
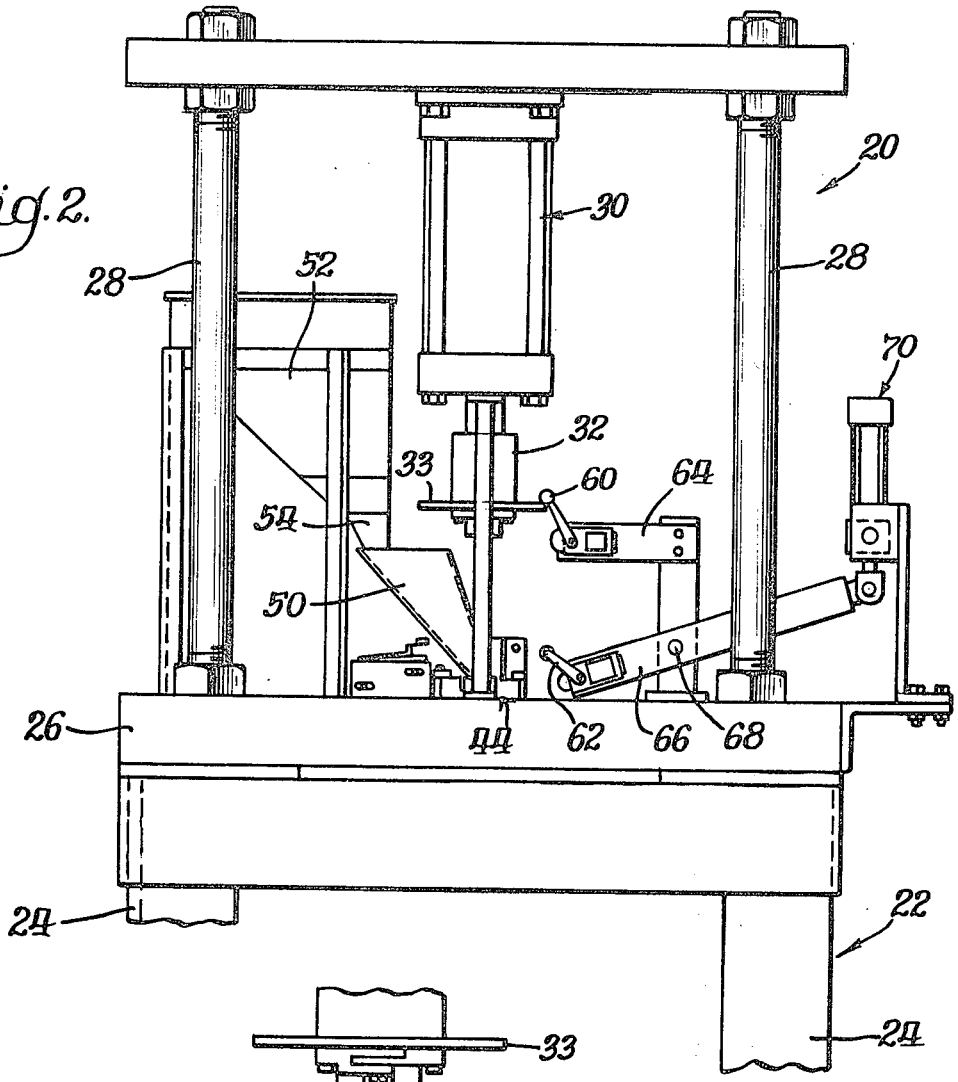
FIG. 2 is a fragmentary rear elevational view taken from the right of FIG. 1 showing the upper portion of the apparatus.

Mounted on the bed 26 is a feed shoe 44 having an opening 46 which defines a feed aperture, through which powdered metal is adapted to flow. The feed shoe 44 is slidable on the bed 26 between a retracted position shown in full lines and an advanced or feeding position as shown in FIG. 2. The feed shoe 44 is moved between the retracted and feeding positions by a hydraulic cylinder-ram device or jack 48.

The press is preferably operated by conventional built-in controls (not shown) so that the feed shoe 44 advances and retracts as the jack 30 reciprocates between its limit positions. The feed shoe 44 is provided with limit switches (not shown) preventing lowering of the jack 30 when the feed shoe 44 is in advanced position.

Mounted on and slidable with the feed shoe 44 is a feed hopper 50 having a bottom outlet communicating with the aperture 46. Above the feed hopper 50 is a stationary supply hopper 52 having a spout 54 leading into the feed hopper 50. The powdered metal 56 from which the continuous rod is formed is stored in the supply hopper 52 and flows through the spout 54 into the feed hopper 50 and from there therough the aperture 46 in the feed shoe 44 into the die unit 36. The feed hopper 50 is constructed so that the spout 54 remains in continuous communication therewith as the feed hopper 50 moves between the retracted and advanced positions.

The arrangement as shown in FIG. 2 also includes a pair of vertical control switches including an "up" limit switch 60 and a "down" limit switch 62. The switch 60 is mounted on a stationary frame element 64 while the down limit switch 62 is mounted on a lever arm 66 pivoted at 68 on a suitable stationary element such as the frame element 64. The lever arm 66 and thus the switch 62 is controlled by a cylinder-ram device, or stroke adjustment jack 70. The up and down limit switches 60, 62 are actuated by the actuator or plate 33, mounted on the ram 32 for movement thereby to limit the length of the stroke of the ram, and reverse the direction of the ram. The down limit switch 62 is adjustable vertically, as hereinafter described.

Figure 11:
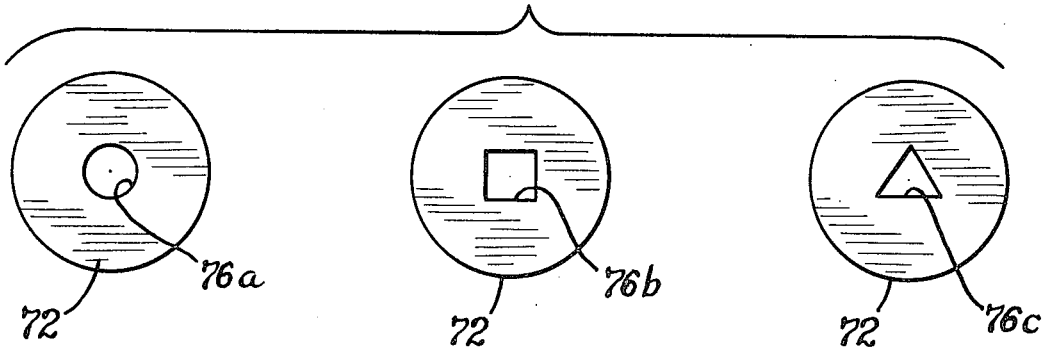
FIG. 11 is a view showing several selected cross-sectional shapes of die cavity, each oriented along the lines 11—11 of FIG. 3.

The die unit 36 includes a die 72 (FIG. 3) and a holder 74 therefor, the holder being secured in the bed 26 in any suitable manner as by a shoulder indicated at 73 and a retainer ring 73*a*. The die 72 may be made from hardened steel and includes a cavity 76 which may be any of various fixed cross-sectional shapes such as shown in FIG. 11, for example, round, square, and triangular designated respectively as 76*a*, 76*b* and 76*c*. The die 76 is open at both ends and the cavity 76 is ground to a smooth finish. Preferably, the grinding is performed in the direction of compaction of the powdered metal. The die holder 74 has a threaded counterbore 78 in line with the cavity 76 for receiving a stopper or closure plug 79 which is placed in position in the initial portion of the forming operation as explained hereinbelow, and later removed. Such a plug is shown in position in FIGS. 3 and 6, and removed therefrom in FIG. 7, wherein a portion of the formed bar or rod extends beyond the die cavity 76 and through the threaded counterbore 78.

Figure 1:
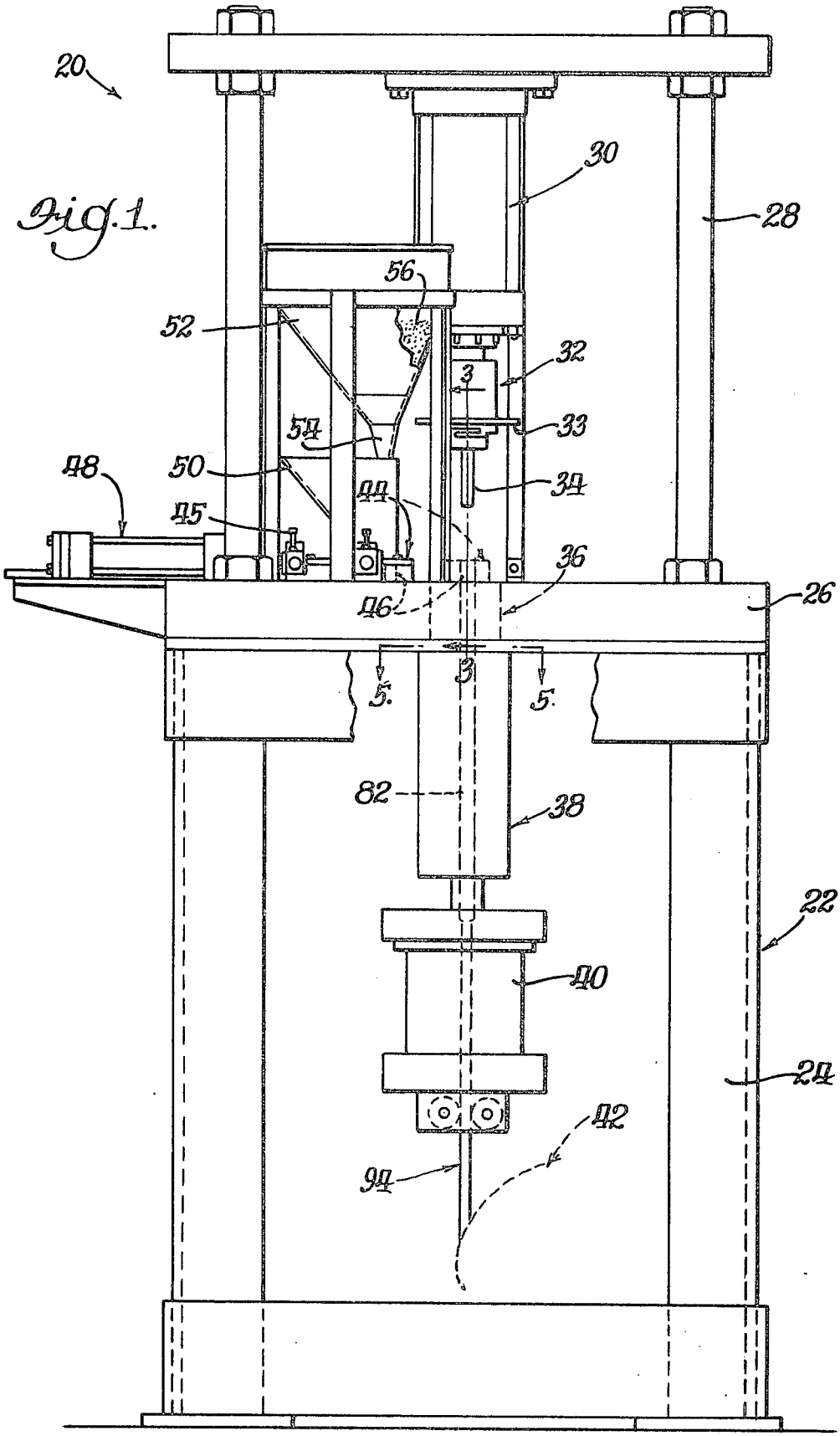
FIG. 1 is a side elevational view of an apparatus, for carrying out the method of the invention.

In the operation of the press, a supply of the powdered metal 56 is maintained in the supply hopper 52 and the powdered metal flows through the spout 54 into the feed hopper 50 and feed aperture 46 of the feed shoe 44. The feed aperture 46 is closed-off by the base until the shoe 44 moves to advanced position and is aligned with the die cavity 76. When in alignment, the powdered metal flows through the feed aperture 46 until the cavity 76 is filled. In this manner the quantity of powder introduced into the die is controlled or determined by the volume of the space in the die cavity 76 above the stopper 79 or rod segment remaining in the die as more fully to be described hereinafter. It is also possible to control the quantity of powdered metal by other means. Upon retraction of the feed shoe 44, the press cylinder 30 is pressurized through line 85 (FIG. 4) to actuate ram 32 so that the punch 34 enters the die cavity 76 to compact the powdered metal against the stopper or rod in the cavity 76. Successive quantities of powdered metal are introduced and compacted and bonded to the preceding compacted powdered metal to form the bar 94 as more fully to be described hereinafter. As the bar or rod 94 is formed, it is forced downwardly out of the die 36 and into the sintering furnace 38 through a central opening 82, and after the rod passes through the sintering furnace, it continues through the rotary swager 40. This swager is of known construction and need not be described in detail. Generally, it is of the creeping spindle type, which prevents rotation of the bar 94. The swager reduces the diameter of the bar to a suitable extent, such for example as one-half of the cross-sectional area at 76, and as the bar passes through the swager it is wound on the reel 42 or placed in other suitable supply holders. The sintering furnace 38 includes a body 80 (FIGS. 1 and 5) with the longitudinal opening 82 therein. The furnace is heated by induction coils 84 (FIG. 5) of suitable number and capacity to provide the desired temperature as referred to hereinbelow.

In the initial compaction of the powder to form the bar 94, the closure plug 79 is inserted in the counterbore 78 and a quantity of powdered metal is placed in the die cavity and compacted against the plug to form a segment of the bar. If the segment, thus formed has the desired physical characteristics and frictional resistance with the cavity wall to serve as a stop, the plug 79 is removed. The compacted segment of the bar in the cavity now serves as a stop means or stopper. If necessary, a plurality of quantities of metal powder may be compacted prior to removal of the plug 79 to achieve a length of bar having the requisite frictional engagement with the cavity wall to serve as a stopper. Another quantity of powder is introduced and another compaction performed. This quantity is compacted against the last formed segment of the bar in the cavity and bonded thereto. When the ram approaches the end of its stroke the force transmitted through the compacted segment is sufficient to overcome the frictional forces between the rod and the cavity wall so that the bar 94 is projected at least partially out of the die cavity. This process is repeated until the bar is of a desired length.

Figure 8:
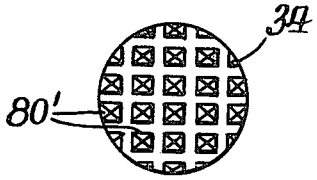
FIG. 8 is an end view of a press punch showing one pattern on the end surface.
Figure 9:
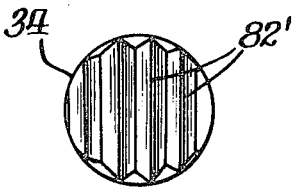
FIG. 9 is an end view of a press punch showing another pattern.

FIGS. 8 and 9 show non-planar end surfaces of the punch, FIG. 8 showing a corrugated "waffle" pattern 80' while FIG. 9 shows a corrugated "ripple" pattern 82'. These corrugations form a corresponding configuration in the end of the segment thereby causing bonding of the succeeding quantity of powdered mtal thereto during compaction in the die 72 as a further segment of the bar.

FIG. 4 shows an electro hydraulic system for controlling the length of the stroke of the press ram 32 to compensate for the changes in volume in the die cavity 76 for reasons which will become apparent hereinafter. The press cylinder of jack 30 is incorporated in a hydraulic circuit 85 which also includes "high" and "low" switches 86, 87, respectively. These switches are ordinary pressure actuated switches and are responsive to the pressure forces sensed in the cylinder 30. FIG. 4 also shows a hydraulic valve 88 actuated by solenoids 89—89 which in turn are activated by internal controls (not shown) in the press for reciprocating the cylinder or jack 30 as referred to above. This valve and the actuation thereof by the soldenoids are well-known in the art.

The stroke adjustment ram 70 is associated with the hydraulic valve 88 and solenoid 89 for controlling the length of the stroke of the ram. Controlling the stroke adjustment ram 70 is a hydraulic valve 90 also of known kind and which may be of the same kind as the valve 88, actuated by an "up" solenoid 92 and a "down" solenoid 95 controlled, respectively, by the high and low pressure switches 86,87. As the press ram 32 descends to engage the down limit switch 62, the switches 86, 87 sense the pressure applied by the ram. If the pressure so sensed is higher than a predetermined maximum value the high pressure switch 86 senses the pressure in the hydraulic line 85, and energizes the "up" solenoid 92 which thereby actuates the valve 90 which controls the jack 70, retracting the piston therein and lowering the down limit switch 62. This lengthens the extent of the travel of the press ram 32. On the other hand, if the pressure is less than a predetermined minimum value the low pressure switch 87 senses that pressure, and actuates the down solenoid 95 which actuates the jack 70 in the opposite direction. This results in raising the down limit switch 62 to shorten the travel of ram 32 (FIG. 2).

Thus the force exerted by the punch in compacting the powder in the die against the previously formed length of bar remaining seated in the die is measured. This compacting force also equals the resisting frictional force between the previously formed length of bar remaining in the die and the die wall. As heretofore mentioned, the frictional force between the previously compacted slug and the cavity wall serve to retain the bar within the die to provide a stop means against which the powdered metal is compacted. The compacting and the corresponding ejecting force must therefore be greater than the frictional force existing at the cavity wall. At the same time the force must not be of a magnitude that causes compacted powder to be wedged within the cavity so that it cannot be extracted without either damaging the bar or the die. On the other hand, the force applied must be such that the powdered metal is compacted and bonded to the previously formed length of bar. In establishing the prerequisite force, the initial pressing force or pressure is critical in order to produce a bar having the desired green compact characteristics, primarily density. Preferably, such green compact bar should have about a 70% density so as to be self-supporting and capable of withstanding the handling forces imposed thereon during transfer to a sintering or swaging station or the like.

Further factors in the carrying out of the method of the present invention are die design, surface area of the formed bar remaining in the die, powder properties, and lubrication.

The die is made from a material having a hardness and surface finish which minimizes galling. Preferably, the die surface or cavity wall is ground in the direction in which the rod is pressed or forced through the die. The die is also provided with a radius **76*a* at the punch entrance end thereof to serve as a punch guide. A short distance at the exit end 76*b* of the cavity 76** is tapered or flared outwardly to the extent that the compacted rod is permitted to expand gradually. The gradual taper allows the rod to expand as the compacted material attempts to relieve itself of the stresses developed during compaction. In the absence of taper the rod may crack due to a sudden or abrupt expansion.

The powder properties such as particle size, hardness, and particle size distribution may affect the friction developed at the cavity wall during compaction. These properties will affect the pressing pressures and the slug length.

The metal powder mix also includes a lubricant. The lubricant will affect the frictional characteristics along the cavity during compaction.

The above factors are all considered for producing a rod of substantially constant density along its length. However, because of variations in the metal powder properties, lubrication and the like, it is not possible to precisely predict the total length of the bar which remains in the die after each compaction. The total area of the rod remaining in the die directly determines the frictional resisting force and the compacting force which must be applied to eject the rod from the die. When the die is filled to the end of the cavity an increase or decrease of the volume remaining in the die results in corresponding decrease or increase in the volume of metal powders to be compacted. Under these conditions there is also corresponding increase or decrease in the compacting force sensed by the high pressure switch 86 and low pressure switch 87. This causes the stroke adjustment ram 70 to be adjusted as above explained to achieve the desired uniform physical characteristics. This measurement and adjustment is not only made during the initial formation of the bar, but is also made whenever the physical characteristics of the bar deviate from the desired characteristics.

In carrying out the method, powder of the material desired, e.g., iron, stainless steel composition, etc. of a size of less than 500 microns is generally utilized. A lubricant which may for example be — Acrawax "C" — made by Glyco Chemical Co., or any of various other kinds of prior art lubricants, is thoroughly admixed with the powder.

In one practical example of utilizing the method, a stainless steel powder was compacted in the die to about one-half its original volume. The stainless steel was a type 316 stainless steel having the following composition:

| Elements | % By Weight |
|---|---|
| Carbon | .022 |
| Manganese | .035 |
| Silicon | .62 |
| Chromium | 16.05 |
| Nickel | 13.90 |
| Molydenum | 2.15 |

The above stainless steel composition was admixed with Acrawax "C" to about 1 ¾% of the powder by weight.

The powder was introduced into the die cavity filling a length of the latter of about 3 inches, and after compaction it formed a segment of the bar of about 1 ½ inches.

Figure 10:
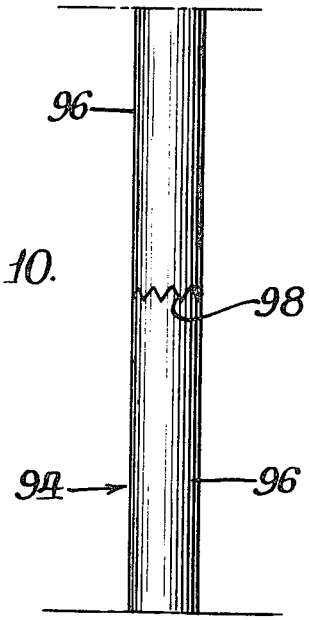
FIG. 10 is a view of a portion of a rod showing schematically a joint between adjacent segments of the rod.

The adjacent segments were compacted and bonded together as mentioned above, forming a continuous integral bar, identified at 94, the segments being individually identified 96 (FIG. 10) and the bond therebetween at 98. In actual practice, the line 98 was substantially undiscernible. When the bar was subjected to bending stresses during test there was no greater tendency for the bar to break at 98 than at any other location stressed to the breaking point.

As each new quantity of powder was introduced and a segment formed, the continuous integral bar was forced out of the lower end of the die and continuously through the furnace as noted above, and in the sintering operation, the lubricant was burned out of the bar.

In the initial compacting step, when the closure plug 79 was in place, a compaction pressure of about 20–25 tons per square inch (tsi) was utilized. After the plug was removed, and a subsequent quantity of powdered metal was introduced into the die cavity, a greater compacting pressure was utilized, such as between 30 and 40 tsi, and at an average of about 35 tsi.

The continuous bar thus formed was sintered at a temperature of the order of about 2150° F., preferably for a period of about one-half minute.

The bond 98 was along an irregular or non-planar conformation formed by a correspondingly shaped end surface of the punch, as shown in FIG. 9, the bond including overlapping extensions or elements which enhances bonding. It has been found that the strength at the bond is substantially the same as in other portions of the bar 94 both after green compaction and after sintering.

The pressure utilized creates substantial green strength in the bar, i.e., strength after compacting but before sintering, so that the bar can be handled in its green state without disintegration particularly when forcing it out of the die and through the sintering furnace.

Metal powders of A.I.S.I. M-2 tool steel, Eatonite, Copper 100-RXN, aluminum type 601-AS (Alcoa), stellite-6B, and iron powder of A.O. Smith Inland 300M were compacted in a manner generally similar to the method described above. The metal powders of each of the different ferrous and non-ferrous metals were continuously formed into a green rod of a desired length and capable of being self-supporting and handling.

What is claimed is:

1. A continuous method of forming a bar from a powdered metal comprising successively introducing a quantity of powdered metal into a die having a substantially nonexpansible cavity, compacting each quantity of metal powder into bonded segments of a bar of which at least a length of the bar frictionally engages the walls of the die cavity and serves as a stop means against which subsequent quantities of powdered metal are compacted and bonded to form further segments of the bar, measuring the frictional resisting force of the length of bar in the cavity relative to a predetermined maximum and a predetermined minimum resisting force between which a subsequent quantity of powdered metal is compacted into a segment of predetermined physical characteristics, controlling the compaction whenever the measured force is greater than the predetermined maximum or less than the predetermined minimum so that the successive quantity of powdered metal is bonded to the bar as a segment having the desired physical characteristics, and forcing the bar through the die so that at least a length of said bar serves as the stop means.

2. The method as defined in claim 1 wherein a pressure force is axially applied in the die to compact each of said quantities of powdered metal.

3. The method as defined in claim 2 wherein the control of the compaction comprises varying length of travel of the axially applied pressure force and the volume of the quantity of powdered metal relative to each other.

4. The method as defined in claim 2 wherein said die cavity is of a fixed volume, and the control of the compaction comprises varying the length of travel of the axially applied pressure force in the die cavity.

5. The method as defined in claim 4 wherein the length of travel is varied at the end of the travel into die member toward said stop means and the retraction end of the travel away from the stop means is maintained constant.

6. A method according to claim 1 and including the step of incorporating a lubricant in the powdered metal forming the continuous bar.

7. A method according to claim 6 wherein the lubricant incorporated in the metal powder is about 1% of the powdered metal by weight.

8. The method as defined in claim 1 and including the step of moving a punch into the die for compacting the powder and forming a resulting segment of the bar, and wherein the control of the compaction comprises varying the pressure of the punch on the metal powder by varying the length of each stroke of the punch in proportion to the pressure applied to the metal powder.

9. The method as defined in claim 1 wherein the bar is continuously sintered as the bar emerges from the die.

10. The method as defined in claim 9 in which the sintering is performed by induction heating.

11. A continuous method of forming a bar comprising introducing a quantity of metal powder into a die cavity having a stop means at one end, applying a pressure force through a pressure force applying means axially reciprocable in said cavity for compacting the powdered metal against the stop into a segment of a bar of selective physical characteristics and frictionally engagable with the cavity walls so that the bar in the cavity forms a stop means against which subsequent quantities of powdered metal introduced into the cavity may be compacted, measuring the frictional resisting force of the length of bar in the cavity relative to a predetermined maximum and a predetermined minimum resisting force, repeatedly introducing a quantity of powdered metal into the cavity, applying said pressure force after each introduction of a quantity of powdered metal to compact the quantity of metal powders into segments bonded to each other to form a bar which is forced out of the die cavity with at least a length of the bar frictionally engagable with the cavity wall to define the stop, and controlling the length of travel of the axially reciprocable pressure force applying means whenever the measured force is greater than the predetermined maximum or less than the predetermined minimum such that each quantity of powdered metal introduced in said cavity is compacted into a segment of substantially the same physical characteristics as the remainder of the bar.

12. The invention as defined in claim 1 wherein said die body comprises a hard surface cavity wall having a ground finish that is ground in the direction in which the powdered metal is compressed and compacted.

* * * * *